US011401944B2

(12) United States Patent
Yamashita et al.

(10) Patent No.: US 11,401,944 B2
(45) Date of Patent: Aug. 2, 2022

(54) IMPELLER AND CENTRIFUGAL COMPRESSOR

(71) Applicant: MITSUBISHI HEAVY INDUSTRIES COMPRESSOR CORPORATION, Tokyo (JP)

(72) Inventors: Shuichi Yamashita, Tokyo (JP); Miku Kuroda, Tokyo (JP); Hiroaki Oka, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/189,660

(22) Filed: Mar. 2, 2021

(65) Prior Publication Data

US 2021/0301831 A1 Sep. 30, 2021

(30) Foreign Application Priority Data

Mar. 27, 2020 (JP) ..... JP2020-058251

(51) Int. Cl.

| | |
|---|---|
| ***F04D 29/18*** | (2006.01) |
| ***F04D 29/28*** | (2006.01) |
| ***F04D 29/44*** | (2006.01) |
| *F04D 17/12* | (2006.01) |

(52) U.S. Cl.

CPC ..... *F04D 29/284* (2013.01); *F04D 29/444* (2013.01); *F04D 17/122* (2013.01); *F05D 2240/305* (2013.01); *F05D 2240/306* (2013.01); *F05D 2250/51* (2013.01); *F05D 2250/52* (2013.01); *F05D 2250/70* (2013.01)

(58) Field of Classification Search

CPC ..... F04D 29/284; F04D 29/286; F04D 29/30; F04D 17/122; F05D 2240/305; F05D 2240/306; F05D 2250/51; F05D 2250/52

See application file for complete search history.

(56) References Cited

U.S. PATENT DOCUMENTS

| | | | | |
|---|---|---|---|---|
| 5,735,672 | A * | 4/1998 | Mrotek | B23K 9/028 416/213 A |
| 9,163,642 | B2 | 10/2015 | Masutani | |
| 10,648,480 | B2 * | 5/2020 | Echeverri | F04D 29/2294 |

(Continued)

FOREIGN PATENT DOCUMENTS

| | | | |
|---|---|---|---|
| JP | S60-088898 | A | 5/1985 |
| JP | 2012-177320 | A | 9/2012 |
| WO | 2018-042653 | A1 | 3/2018 |

*Primary Examiner* — Ninh H. Nguyen

(74) *Attorney, Agent, or Firm* — Osha Bergman Watanabe & Burton LLP

(57) ABSTRACT

The impeller includes a disc having a main surface extending outward in a radial direction toward one side in an axial direction, a plurality of blades defining a flow path extending to an outlet on one side from an inlet on the other side in the axial direction, and a cover disposed to cover the plurality of blades. At least one of an inlet side region and an outlet side region which are a connection portion between the blade and the main surface and a connection portion between the blade and the cover has a small fillet portion curved in an arc shape and having a small radius of curvature. An intermediate region formed between the inlet side region and the outlet side region has a large fillet portion having a large radius of curvature.

6 Claims, 4 Drawing Sheets

(56) References Cited

U.S. PATENT DOCUMENTS

| | | | | |
|---|---|---|---|---|
| 2016/0001406 | A1* | 1/2016 | Ahn | B23K 9/23 416/189 |
| 2016/0245297 | A1* | 8/2016 | Husted | F04D 29/668 |
| 2019/0126364 | A1 | 5/2019 | Takagi et al. | |

* cited by examiner

IMPELLER AND CENTRIFUGAL COMPRESSOR

BACKGROUND OF THE INVENTION

Field of the Invention

The present disclosure relates to an impeller and a centrifugal compressor.

Priority is claimed on Japanese Patent Application No. 2020-058251, filed on Mar. 27, 2020, the content of which is incorporated herein by reference.

Description of Related Art

As an impeller used in a centrifugal compressor, an impeller having a form called a closed type is known. This type of the impeller has a disc, a blade, and a cover. An outer peripheral surface of the disc extends outward in a radial direction toward one side in an axial direction. A plurality of blades arrayed at an interval in a circumferential direction are provided on the outer peripheral surface. The cover covers the blades from an outside in the radial direction. In this manner, the impeller has an impeller flow path surrounded by a pair of the blades adjacent to each other, the disc, and the cover.

Fillets are formed in a connection portion between the blade and the disc and a connection portion between the blade and the cover in order to mainly smooth a flow of a fluid. The fillet connects the blade and the disc to each other and the blade and the cover to each other in an arc shape, when viewed in an extending direction of the blade. As disclosed in WO2018/042653, in the related art, a radius of curvature of the fillet is generally constant over an entire region of a flow path.

Here, it is known that a behavior of the fluid inside the impeller flow path greatly varies among a region on an inlet side, a region on an outlet side, and an intermediate region between the regions. In particular, it is known that the flow is separated on the inlet side due to a sudden change in a cross-sectional area of the flow path with respect to the flow path on a front stage side having an annular shape. In addition, there is a possibility that a disturbance may start from the above-described fillet.

Therefore, a method of thinning a leading edge of the blade or a method of filling a space in a separated location has been proposed.

In addition, a technique for setting a shape of the fillet so that the cross-sectional area of the flow path is gradually changed from the inlet side to the outlet side of the impeller flow path has also been proposed.

SUMMARY OF THE INVENTION

In view of influence on the flow, it is desirable that the fillet is small. However, in order to relieve stress concentration acting on a joint portion among the blade, the disc, and the cover, the fillet needs to have a corresponding size. In this way, a size and a shape of the fillet need two contradictory requirements. Therefore, when the radius of curvature of the fillet is constant as described above, there is a possibility that performance of the impeller may not be sufficiently achieved.

The present disclosure is made to solve the above-described problems, and an object thereof is to provide an impeller and a centrifugal compressor which have further improved performance.

According to the present disclosure, in order to solve the above-described problems, an impeller is provided including a disc rotatable around an axis, the disc having a main surface extending outward in a radial direction toward one side in an axial direction; a plurality of blades disposed on the main surface at an interval in a circumferential direction and defining a flow path extending to an outlet on one side from an inlet on the other side in the axial direction; and a cover disposed to face the main surface and to cover the plurality of blades. At least one of an inlet side region including an end portion on the inlet side and an outlet side region including an end portion on the outlet side has a small fillet portion curved in an arc shape and having a relatively small radius of curvature when viewed in an extending direction of the blade at a connection portion between the blade and the main surface and a connection portion between the blade and the cover. An intermediate region formed between the inlet side region and the outlet side region has a large fillet portion curved in an arc shape and having a relatively large radius of curvature when viewed in the extending direction of the blade at the connection portion between the blade and the main surface and the connection portion between the blade and the cover.

According to the present disclosure, it is possible to provide the impeller and the centrifugal compressor which have further improved performance.

DETAILED DESCRIPTION OF THE INVENTION (Configuration of Centrifugal Compressor)

Figure 1:
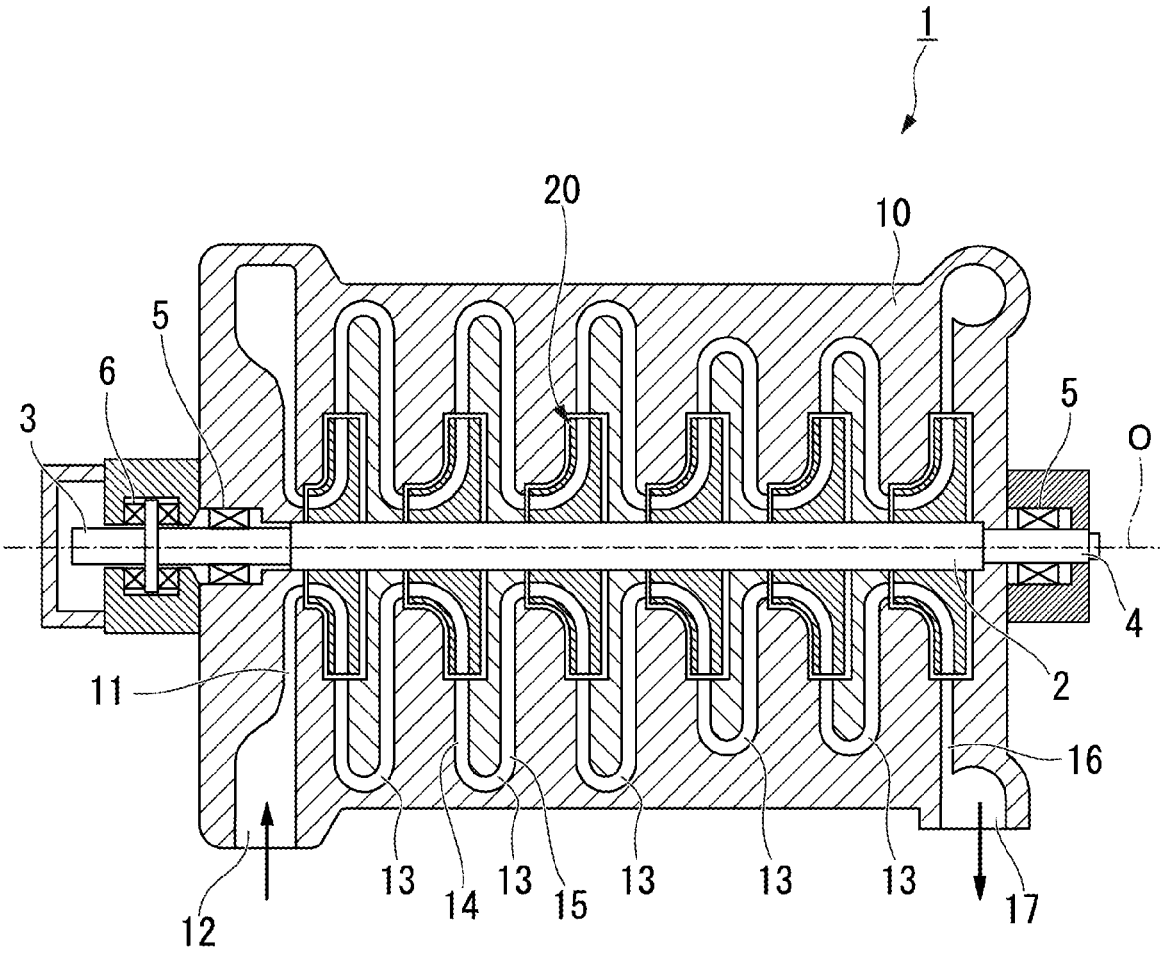
FIG. 1 is a sectional view showing a configuration of a centrifugal compressor according to an embodiment of the present disclosure.

Hereinafter, a centrifugal compressor according to an embodiment of the present disclosure will be described with reference to FIG. 1. As shown in FIG. 1, a centrifugal compressor 1 includes a rotary shaft 2, a journal bearing 5, a thrust bearing 6, an impeller 20, and a casing 10. The centrifugal compressor 1 of the present embodiment is a so-called uniaxial multi-stage centrifugal compressor including a plurality of stages of the impellers 20.

The rotary shaft 2 has a columnar shape extending in a direction of an axis O along a horizontal direction. The rotary shaft 2 is supported to be rotatable around the axis O by the journal bearing 5 on a first end portion 3 side (other side in the direction of the axis O) and a second end portion 4 side (one side in the direction of the axis O) in the direction of the axis O. In the rotary shaft 2, the first end portion 3 is supported by the thrust bearing 6.

The plurality of stages of the impellers 20 are fitted to an outer peripheral surface of the rotary shaft 2, and are provided at an interval in the direction of the axis O. The impellers 20 rotate around the axis O together with the rotary shaft 2 so that gas (fluid) flowing into the impellers 20 in the direction of the axis O is pumped outward in a radial direction. A detailed configuration of the impeller 20 will be described later.

The casing 10 is a member formed in a cylindrical shape, and accommodates the rotary shaft 2, the impeller 20, and the journal bearing 5. The casing 10 supports the rotary shaft 2 to be rotatable via the journal bearing 5. In this manner, the impeller 20 attached to the rotary shaft 2 can rotate relative to the casing 10. The casing 10 has an introduction flow path 11, a connection flow path 13, and a discharge flow path 16.

The introduction flow path 11 introduces the gas from an outside of the casing 10 to the impeller 20 on a forefront stage which is disposed closest to the other side of the plurality of impellers 20 in the direction of the axis O. The introduction flow path 11 is open on an outer peripheral surface of the casing 10, and an opening portion thereof is a suction port 12 of the gas. The introduction flow path 11 is connected to the other side of the impeller 20 on the forefront stage in the direction of the axis O in an inner portion in the radial direction.

The connection flow path 13 is a flow path that connects a pair of the impellers 20 adjacent to each other in the direction of the axis O. The connection flow path 13 introduces the gas discharged outward in the radial direction from the impeller 20 on a front stage side into the impeller 20 on a rear stage side from the other side in the direction of the axis O. The connection flow path 13 has a diffuser flow path 14 and a return flow path 15.

The diffuser flow path 14 is connected to an outside of the impeller 20 in the radial direction and converts kinematic energy into pressure energy while guiding the gas discharged outward in the radial direction from the impeller 20 to the outside in the radial direction. The return flow path 15 is connected to the outside of the diffuser flow path 14 in the radial direction, diverts the gas flowing outward in the radial direction to an inside in the radial direction, and guides the gas to the impeller 20 on the rear stage side.

The discharge flow path 16 discharges the gas discharged outward in the radial direction from the impeller 20 on a final stage which is disposed closest to one side of the plurality of impellers 20 in the direction of the axis O to the outside of the casing 10. The discharge flow path 16 is open on the outer peripheral surface of the casing 10, and an opening portion thereof a discharge port 17 of the gas. The discharge flow path 16 is connected to the outside in the radial direction of the impeller 20 on the final stage in an inner portion in the radial direction.

(Configuration of Impeller)

Figure 2:
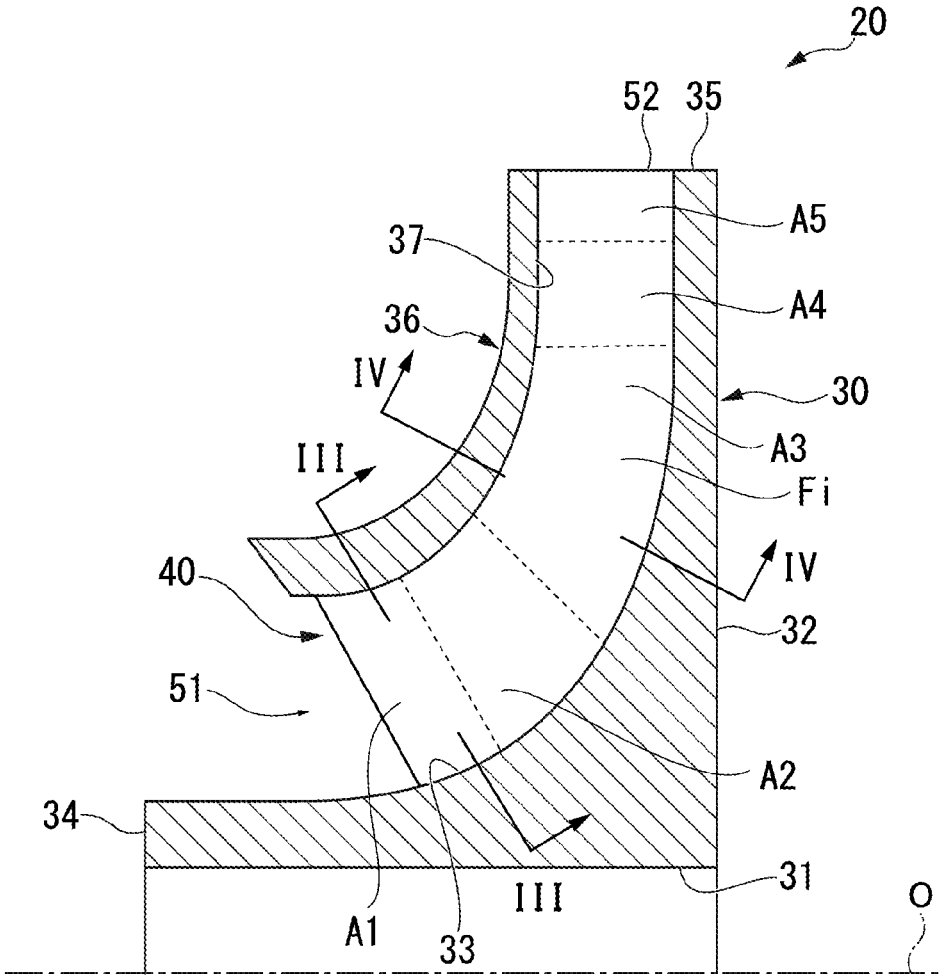
FIG. 2 is a sectional view showing a cross section including an axis of an impeller according to the embodiment of the present disclosure.

Next, a configuration of the impeller 20 will be described with reference to FIGS. 2 to 4. As shown in FIG. 2, the impeller 20 has a disc 30, a blade 40, and a cover 36.

The disc 30 is formed in a disc shape around the axis O. The disc 30 has a circular shape around the axis O and has a through-hole 31 penetrating in the direction of the axis O. An inner surface of the through-hole 31 is fitted into an outer peripheral surface of the rotary shaft 2 such that the impeller 20 is integrally fixed to the rotary shaft 2.

A surface facing the other side in the direction of the axis O in the disc 30 is a disc rear surface 32 having a planar shape orthogonal to the axis O. A disc main surface 33 (main surface) gradually extending outward in the radial direction from the other side toward one side in the axial direction is formed from an end portion on the other side in the direction of the axis O of the through-hole 31 in the disc 30 to an end portion outside in the radial direction of the disc rear surface 32. A portion on the other side in the direction of the axis O in the disc main surface 33 faces outward in the radial direction, and is gradually curved to face the other side in the direction of the axis O toward one side in the direction of the axis O. That is, a diameter of the disc main surface 33 gradually increases toward one side from the other side in the direction of the axis O. The disc main surface 33 has a recessed and curved surface shape.

In the present embodiment, a disc front end surface 34 having a planar shape orthogonal to the direction of the axis O is formed between an end portion on the other side in the direction of the axis O of the disc main surface 33 and an end portion on one side in the direction of the axis O of the through-hole 31. A disc outer end surface 35 extending in the direction of the axis O and serving as an outer peripheral edge portion of the disc 30 is provided between one end portion in one side in the direction of the axis O of the disc main surface 33 and an end portion outside in the radial direction of the disc rear surface 32.

The plurality of blades 40 are provided at an interval in the circumferential direction of the axis O on the disc main surface 33 in the disc 30. Each of the blades 40 is curved toward a rear side (one side in the circumferential direction) in a rotation direction of the impeller 20 from the inside in the radial direction to the outside in the radial direction. Each of the blades 40 extends while forming a projecting and curved surface which projects toward a front side in the rotation direction.

The cover 36 covers the plurality of blades 40 from an outer peripheral side. The cover 36 is provided to face the disc main surface 33 so that the blade 40 is interposed between the disc 30 and the cover 36. An inner peripheral surface 37 of the cover 36 is formed so that the diameter gradually increases toward one side from the other side in the direction of the axis O. The inner peripheral surface 37 of the cover 36 is curved in the same manner as the disc main surface 33 to correspond to the disc main surface 33. An end portion on a side opposite to the disc main surface 33 side in the blade 40 is fixed to the inner peripheral surface 37 of the cover 36.

The inner peripheral surface 37 of the cover 36, the disc main surface 33, and the pair of blades 40 adjacent to each other form a flow path (impeller flow path Fi) therebetween, which extends to be curved to the rear side in the rotational direction from one side toward the other side in the direction of the axis O.

Figure 5:
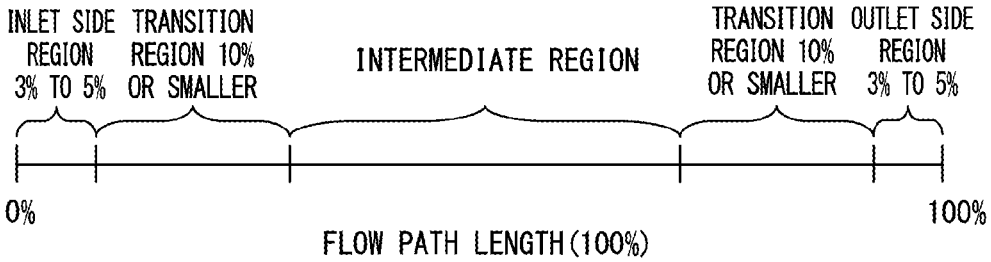
FIG. 5 is a view for describing a dimensional ratio of each region in the impeller according to the embodiment of the present disclosure.

The impeller flow path Fi is divided into a plurality of regions from the inlet 51 to the outlet 52. Specifically, the impeller flow path Fi has an inlet side region A1, a transition region A2, an intermediate region A3, a transition region A4, and an outlet side region A5 in this order from the inlet 51 toward the outlet 52. As shown in FIG. 5, when a length of the impeller flow path Fi is defined as 100%, the inlet side region A1 is a region of 3% to 5% from the inlet 51 of the impeller flow path Fi. The outlet side region A5 is a region of 3% to 5% from the outlet 52 of the impeller flow path Fi. The length of the transition regions A2 and A4 is 10% or smaller, when the length of the impeller flow path Fi is defined as 100%.

Figure 3:
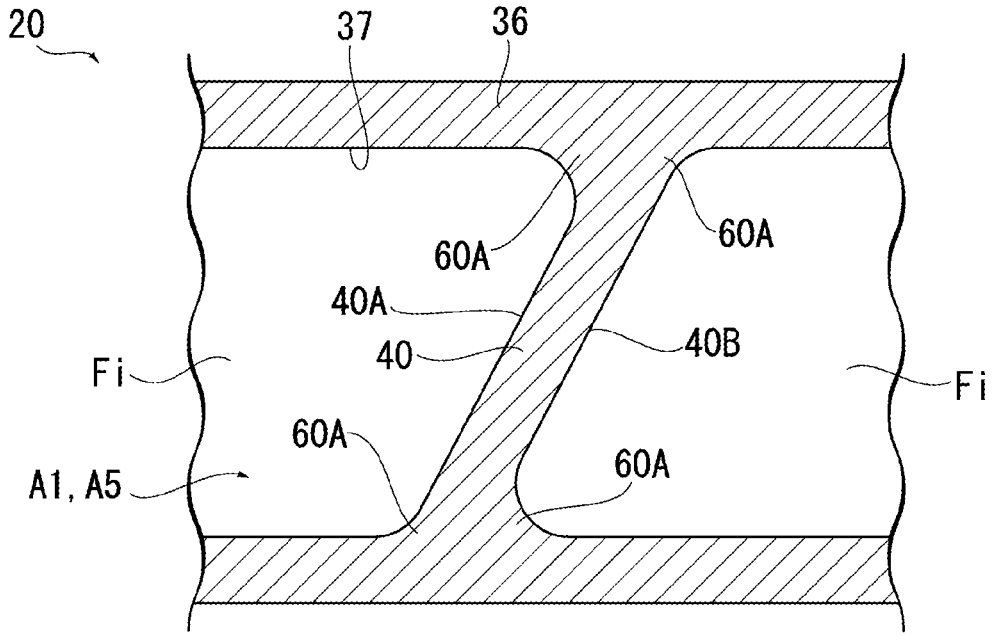
FIG. 3 is a sectional view taken along line in FIG. 2.

As shown in FIG. 3, in the inlet side region A1 and the outlet side region A5, fillets (small fillet portions 60A) are each formed in a connection portion between the blade 40 and the disc 30 and a connection portion between the blade 40 and the cover 36. More specifically, the small fillet portions 60A are each formed in a portion between the disc main surface 33 and a pressure side surface 40A of the blade 40, a portion between the disc main surface 33 and a suction side surface 40B, a portion between the inner peripheral surface 37 of the cover 36 and the pressure side surface 40A of the blade 40, and a portion between the inner peripheral surface 37 of the cover 36 and the suction side surface 40B. Each of the small fillet portions 60A has a curved surface having an arc shape, when viewed in the extending direction of the flow path Fi. A radius of curvature of the small fillet portion 60A is preferably as small as possible since the radius of curvature reduces a cross-sectional area of a flow path of a fluid entering the impeller (as described in the front stage). On the other hand, the blade of the impeller which centrifugally compresses the fluid greatly bends a flow direction by applying a large (turning) force to the fluid. Accordingly, in order to relieve stress acting on a joint portion among the blade, the disc, and cover, the fillet having required dimensions is set as the radius of curvature of the small fillet portion 60A. An example in FIG. 3 shows a configuration in the respective small fillet portions 60A has mutually the same radius of curvature within the same cross section. However, it is also possible to adopt a configuration in which the radii of curvature are different from each other.

Figure 4:
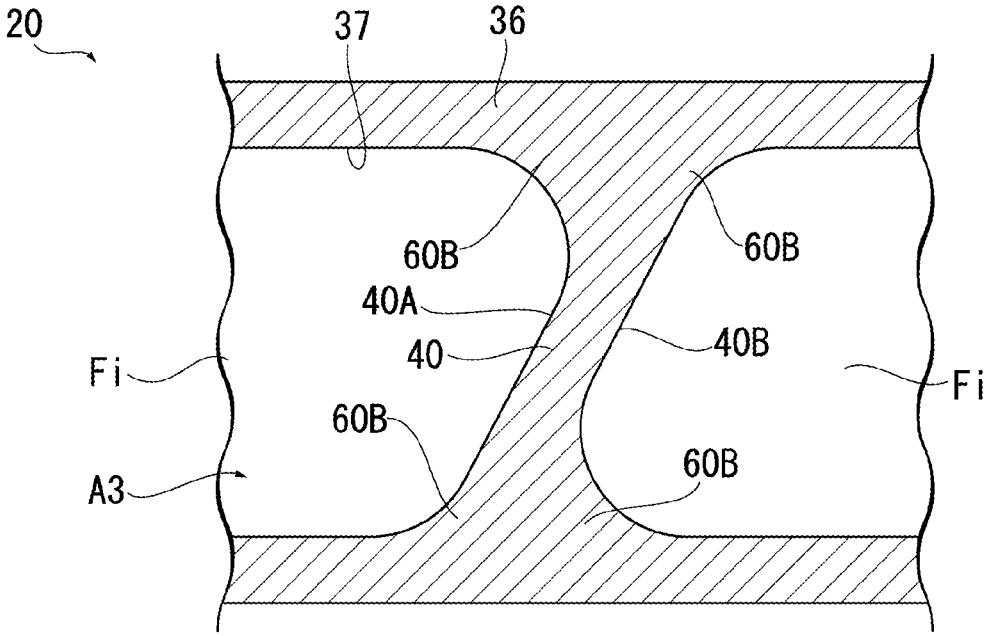
FIG. 4 is a sectional view taken along line IV-IV in FIG. 2.

Furthermore, as shown in FIG. 4, in the intermediate region A3, fillets (large fillet portions 60B) are each formed in a connection portion between the blade 40 and the disc 30 and a connection portion between the blade 40 and the cover 36. More specifically, the large fillet portions 60B are each formed in a portion between the disc main surface 33 and the pressure side surface 40A of the blade 40, a portion between the disc main surface 33 and the suction side surface 40B, a portion between the inner peripheral surface 37 of the cover 36 and the pressure side surface 40A of the blade 40, and a portion between the inner peripheral surface 37 of the cover 36 and the suction side surface 40B. Each of the large fillet portions 60B has a curved surface having an arc shape, when viewed in the extending direction of the flow path Fi. It is desirable that the radius of curvature of the large fillet portion 60B is set to be relatively larger than the radius of curvature of the above-described small fillet portion 60A. More preferably, the radius of curvature of the large fillet portion 60B is 1.2 times to 3 times the radius of curvature of the small fillet portion 60A. Most preferably, the radius of curvature of the large fillet portion 60B is 1.5 times to 3 times the radius of curvature of the small fillet portion 60A. An example in FIG. 4 shows a configuration in which the respective large fillet portions 60B have mutually the same radius of curvature within the same cross section. However, it is also possible to adopt a configuration in which the radii of curvature are different from each other.

Although not shown in detail, other fillets connecting the small fillet portion 60A and the large fillet portion 60B to each other are formed in the transition regions A2 and A4. In the fillets of the transition regions A2 and A4, the radius of curvature gradually increases from the small fillet portion 60A toward the large fillet portion 60B. In this manner, the small fillet portion 60A and the large fillet portion 60B are smoothly connected to each other.

(Operational Effect)

Next, an operation of the centrifugal compressor 1 will be described. When the centrifugal compressor 1 is driven, the rotary shaft 2 is first rotated by an external power source. The impeller 20 is integrally rotated in conjunction with the rotation of the rotary shaft 2. In this manner, an external fluid is fetched into the centrifugal compressor 1 through the above-described introduction flow path 11. The fluid is compressed as the fluid flows through the flow path between the blades 40 of the impeller 20, is converted into a high pressure fluid, and flows into the connection flow path 13. The fluid flowing into the connection flow path 13 is further compressed by the impeller 20 in the rear stage. This cycle is repeated until the fluid reaches the impeller 20 on the final stage, and finally, the fluid having a target pressure is discharged from the discharge flow path 16.

Incidentally, as described above, in order to relieve stress concentration, fillets are formed in the connection portion between the blade 40 and the disc 30 and the connection portion between the blade 40 and the cover 36. In general, the radius of curvature of the fillet is constant over an entire region of the flow path. Here, in the impeller flow path Fi, particularly in the inlet side region A1, the cross-sectional area of the flow path is suddenly changed (decreases) due to a leading edge portion of the blade with respect to the flow path on the front stage side forming an annular space. Accordingly, the flow in the impeller flow path Fi may be disturbed in some cases. In addition, the above-described fillet is thicker than the blade 40. Accordingly, there is a possibility that the disturbance such as flow separation may start from the fillet. In this way, in order to suppress the influence on the flow, that is, a loss, it is desirable that the fillet is small. However, in order to relieve the stress concentration acting on the connection portion among the blade, the disc, and the cover, the fillet needs to have a corresponding size. That is, in order to secure strength while avoiding the loss in the impeller flow path, a size and a shape of the fillet need two contradictory requirements.

Therefore, in the present embodiment, the small fillet portion 60A is formed in at least one of the inlet side region A1 and the outlet side region A5, and the large fillet portion 60B is formed in the intermediate region A3. According to this configuration, a behavior of the fluid is optimized in the inlet side region A1 and the outlet side region A5, and performance as the impeller 20 can be improved. On the other hand, in the intermediate region A3, the cover 36 needs to be supported by the blade 40. Therefore, higher strength is required than that in the inlet side region A1 and the outlet side region A5. In the above-described configuration, the large fillet portion 60B having a large radius of curvature is formed in the intermediate region A3. Therefore, strength in the intermediate region A3 can be improved.

Here, in the one-piece type impeller in which the disc 30, the blade 40, and the cover 36 are integrally formed, a tool is caused to reach the inside from the inlet 51 side or the outlet 52 side of the impeller flow path Fi during a manufacturing process. In this manner, the flow path is formed by carrying out cutting work. When the fillet in the intermediate region is the large fillet, the amount of the cutting work decreases. Therefore, the configuration leads to a decrease in man-hours or times required for manufacturing the impeller 20.

According to the above-described configuration, the transition regions A2 and A4 are formed between the small fillet portion 60A and the large fillet portion 60B. In the transition regions A2 and A4, the radius of curvature gradually increases from the small fillet portion 60A toward the large fillet portion 60B. Therefore, the fluid can smoothly flow without causing a disturbance or a vortex in the flow of the fluid. In this manner, the performance of the impeller can be further improved.

(Other Embodiments)

Hitherto, the embodiment of the present disclosure has been described in detail with reference to the drawings. However, a specific configuration is not limited to the embodiment, and the present disclosure also includes a design change within the scope not departing from the concept of the present disclosure.

For example, the above-described impeller 20 is suitably applicable not only to the centrifugal compressor 1 but also to a centrifugal pump for pumping a liquid.

In addition, in the above-described embodiment, an example has been described in which the small fillet portions 60A are each formed in both the inlet side region A1 and the outlet side region A5. However, the small fillet portion 60A can be formed only in the inlet side region A1 or only in the outlet side region A5. In order to improve the performance of the impeller 20, it is particularly desirable to form the small fillet portion 60A in the inlet side region A1.

APPENDIX

The impeller 20 and the centrifugal compressor 1 which are described in each embodiment can be recognized as follows, for example.

(1) According to a first aspect, there is provided the impeller 20 including the disc 30 rotatable around the axis O, and having the main surface (disc main surface 33) extending outward in the radial direction toward one side in the direction of the axis O, the plurality of blades 40 disposed on the main surface at an interval in the circumferential direction, and defining the flow path (impeller flow path Fi) extending to the outlet 52 on one side from the inlet 51 on the other side in the direction of the axis O, and the cover 36 disposed to face the main surface and to cover the plurality of blades 40. At least one of the inlet side region A1 including the end portion on the inlet 51 side and the outlet side region A5 including the end portion on the outlet 52 side which are the connection portion between the blade 40 and the main surface and the connection portion between the blade 40 and the cover 36 has the small fillet portion 60A curved in the arc shape and having the relatively small radius of curvature when viewed in the extending direction of the blade 40. The intermediate region A3 formed between the inlet side region A1 and the outlet side region A5 which are the connection portion between the blade 40 and the main surface and the connection portion between the blade 40 and the cover has the large fillet portion 60B curved in the arc shape and having the relatively large radius of curvature when viewed in the extending direction of the blade 40.

According to the above-described configuration, the small fillet portion 60A having the relatively small radius of curvature is formed in at least one of the inlet side region A1 and the outlet side region A5. Furthermore, the large fillet portion 60B having the relatively large radius of curvature is formed in the intermediate region A3 between the inlet side region A1 and the outlet side region A5. In this manner, the behavior of the fluid is optimized in at least one of the inlet side region A1 and the outlet side region A5, and the performance as the impeller 20 can be improved. On the other hand, in the intermediate region A3, the cover 36 needs to be supported by the blade 40. Therefore, higher strength is required than that in the inlet side region A1 and the outlet side region A5. In the above-described configuration, the large fillet portion 60B having the large radius of curvature is formed in the intermediate region A3. Therefore, for example, a plate thickness is thicker than that when the radius of curvature is small. In this manner, the strength in the intermediate region A3 can be improved.

Incidentally, in the one-piece type impeller 20 in which the disc 30, the blade 40, and the cover 36 are integrally formed, the tool is caused to reach the inside from the inlet 51 side or the outlet 52 side of the flow path during the manufacturing process. In this manner, the above-described small fillet portion 60A is formed by carrying out cutting work. On the other hand, as described above, only the large fillet portion 60B is formed in the intermediate region A3. Therefore, in the large fillet portion 60B, it is not necessary to reduce the radius of curvature by carrying out the work, or the amount of the work can be minimized. As a result, it is possible to decrease the man-hours or the times required for manufacturing the impeller.

(2) According to a second aspect, the impeller 20 may further include the transition regions A2 and A4 formed in at least one of the portion between the inlet side region A1 and the intermediate region A3 and the portion between the outlet side region A5 and the intermediate region A3, and having the radius of curvature which gradually increases from the small fillet portion 60A toward the large fillet portion 60B.

According to the above-described configuration, the transition regions A2 and A4 are formed between the small fillet portion 60A and the large fillet portion 60B. In the transition regions A2 and A4, the radius of curvature gradually increases from the small fillet portion 60A toward the large fillet portion 60B. Therefore, the fluid can smoothly flow without causing a disturbance or a vortex in the flow of the fluid. In this manner, the performance of the impeller 20 can be further improved.

(3) According to a third aspect, in the impeller 20, the length of the inlet side region A1 and the outlet side region A5 is 3% to 5% when the length of the flow path is defined as 100%.

According to the above-described configuration, the behavior of the fluid in the inlet side region A1 and the outlet side region A5 is optimized, and the performance as the impeller 20 can be further improved. In addition, the region requiring work for forming the small fillet portion 60A can be minimized. Therefore, the impeller 20 can be more easily manufactured in a shorter period of time.

(4) According to a fourth aspect, in the impeller 20, the length of the transition regions A2 and A4 is 10% or smaller when the length of the flow path is defined as 100%.

According to the above-described configuration, the length of the transition regions A2 and A4 is sufficiently secured. Therefore, the fluid can smoothly flow without causing the disturbance or the vortex in the flow of the fluid. In this manner, the performance of the impeller 20 can be further improved.

(5) According to a fifth aspect, in the impeller 20, the radius of curvature of the large fillet portion 60B is 1.2 times to 3 times the radius of curvature of the small fillet portion 60A.

According to the above-described configuration, the performance of the impeller 20 can be further improved.

(6) According to a sixth aspect, there is provided the centrifugal compressor 1 including the rotary shaft 2 extending along the axis O, the impeller 20 fixed to the rotary shaft 2 according to any one of the above-described aspects, and the casing 10 that covers the rotary shaft 2 and the impeller 20 from the outer peripheral side.

According to the above-described configuration, it is possible to provide the centrifugal compressor 1 which can be more stably operated by improving both the performance and the strength of the impeller 20.

While preferred embodiments of the invention have been described and shown above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCES

1 centrifugal compressor
2 rotary shaft
3 first end portion
4 second end portion
5 journal bearing
6 thrust bearing
10 casing
11 introduction flow path
12 suction port
13 connection flow path
14 diffuser flow path
15 return flow path
16 discharge flow path
17 discharge port
20 impeller
30 disc
31 through-hole
32 disc rear surface
33 disc main surface
34 disc front end surface
35 disc outer end surface
36 cover
37 inner peripheral surface
40 blade
40A pressure side surface
40B suction side surface
51 inlet
52 outlet
60A small fillet portion
60B large fillet portion
A1 inlet side region
A2 transition region
A3 intermediate region
A4 transition region
A5 outlet side region
Fi impeller flow path (flow path)
O axis

What is claimed is:

1. An impeller comprising:

a disc rotatable around an axis, the disc having a main surface extending outward in a radial direction toward one side in an axial direction;

blades disposed on the main surface at an interval in a circumferential direction, and defining a flow path extending from an inlet side of the impeller to an outlet side of the impeller; and a cover disposed to face the main surface to cover the blades, wherein an inlet side region of the impeller includes an end portion on the inlet side, and an outlet side region of the impeller includes an end portion on the outlet side, the inlet side region and the outlet side region each comprise first fillet portions between each of the blades and the main surface and between each of the blades and the cover, an intermediate region formed between the inlet side region and the outlet side region comprises second fillet portions between each of the blades and the main surface and between each of the blades and the cover, the first fillet portions have a first arc shape in a cross section of the flow path, the second fillet portions have a second arc shape in the cross section of the flow path, a radius of curvature of the first arc shape in the cross section of the flow path is smaller than a radius of curvature of the second arc shape in the cross section of the flow path, the intermediate region is provided in a predetermined length along a direction of the flow path, the radius of curvature of each of the second fillet portions in the intermediate region is constant along the direction of the flow path, the inlet side region and the outlet side region are provided in a predetermined length along the direction of the flow path, and the radius of curvature of each of the first fillet portions in the inlet side region and the outlet side region are constant along the direction of the flow path.

2. The impeller according to claim 1, further comprising:

transition regions formed in a portion between the inlet side region and the intermediate region and in a portion between the outlet side region and the intermediate region, wherein radii of curvature of arc shapes of fillets between each of the blades and the main surface and between each of the blades and the cover gradually increase from the first fillet portions toward the second fillet portions.

3. The impeller according to claim 1, wherein a length of the inlet side region and the outlet side region is 3% to 5% when a length of the flow path is defined as 100%.

4. The impeller according to claim 2, wherein a length of each of the transition regions is 10% or smaller when a length of the flow path is defined as 100%.

5. The impeller according to claim 1, wherein the radius of curvature of the second fillet portions is 1.2 times to 3 times the radius of curvature of the first fillet portions.

6. A centrifugal compressor comprising:

a rotary shaft extending along an axis;

the impeller according to claim 1, which is fixed to the rotary shaft; and a casing that covers the rotary shaft and the impeller from an outer peripheral side.

* * * * *